US006474590B2

(12) United States Patent
Ueyama

(10) Patent No.: US 6,474,590 B2
(45) Date of Patent: Nov. 5, 2002

(54) WEB WINDING DEVICE

(75) Inventor: Minoru Ueyama, Katano (JP)

(73) Assignee: Fuji Tekko Co., Ltd., Osaka (JP)

( * ) Notice: Subject to any disclaimer, the term of this patent is extended or adjusted under 35 U.S.C. 154(b) by 0 days.

(21) Appl. No.: 09/908,144

(22) Filed: Jul. 18, 2001

(65) Prior Publication Data

US 2002/0109033 A1 Aug. 15, 2002

(30) Foreign Application Priority Data

Feb. 14, 2001 (JP) ..... 2001-36420

(51) Int. Cl.[7] ..... B65H 18/26
(52) U.S. Cl. ..... 242/547
(58) Field of Search ..... 242/547, 541.1, 242/541, 541.3, 541.4, 541.6, 541.7, 541.5, 542.3, 419

(56) References Cited

U.S. PATENT DOCUMENTS 3,540,671 A * 11/1970 Moehle ..... 242/419
4,196,865 A * 4/1980 Patriksson ..... 242/542.3
5,474,250 A * 12/1995 Birkmann et al. ..... 242/547
6,260,786 B1 * 7/2001 Ueyama ..... 242/547
6,332,589 B1 * 12/2001 Moller et al. ..... 242/541.3

FOREIGN PATENT DOCUMENTS

| | | |
|---|---|---|
| JP | 63-23389 | 6/1988 |
| JP | 6-1502 | * 6/1994 |
| JP | 9-315632 | 12/1997 |

* cited by examiner

*Primary Examiner*—William A. Rivera
(74) *Attorney, Agent, or Firm*—Flynn, Thiel, Boutell & Tanis, P.C.

(57) ABSTRACT

A web winding device versatilely adaptable to a web wound on a winding shaft, e.g., physical properties, thickness, width, winding speed, etc. and yielding an optimal wind roll without entrained air. It contains a touch roller disposed in pressure contact with a wind roll at a web approaching position to it, a guide roller provided adjacently, upstream of the touch roller, and touch roller arms provided with both rollers, the touch and guide rollers being arranged so that the approaching direction of the web to the guide roller and the wrapping direction on the wind roll in pressure contact with the touch roller are kept in parallel and the position of the guide roller is controllable vertically, permitting the regulation of the web approaching angle to the touch roller in pressure contact with the wind roll.

3 Claims, 3 Drawing Sheets

FIG. 3 RRIOR ART
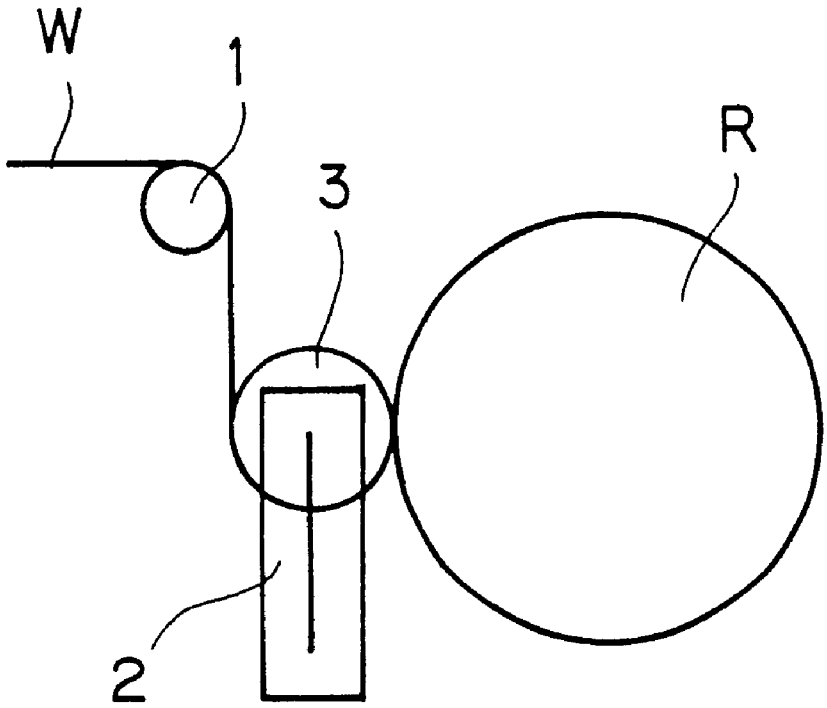

WEB WINDING DEVICE

BACKGROUND OF THE INVENTION

1. Field of the Invention

This invention relates to an improvement in a touch roller device for a winding apparatus for winding up a web or the like which makes pressure contact with a wind roll wound on a winding shaft.

2. Description of Related Art

In winding a web, a winding shaft, on which the web is wound, is rotated by a motor or other drive means to impart a tension to the web, thereby winding it up as a wind roll. In that process, air is entrained between an outer circumferential surface of the wind roll and the web approaching onto the wind roll. In order to adjust the quantity of air entrapped, a roller called a touch roller is provided at a position of the surface of the wind roll where the web approaches and adjusts the pressure of its contact with the wind roll, so that an optimal wind roll is ultimately obtained.

Hitherto the touch roller has been controlled for optimal contact pressure in a manner that its position changes with an increase in diameter of the wind roll and its pressure of rotational movement changes as a contact pressure to the wind roll, but because of a significant error, it has been difficult to obtain an optical contact pressure.

With a view to obtaining an optical contact pressure, therefore, improvements over the conventional touch roller have been investigated, one of which has resulted in a touch roller device as shown in FIG. 3. The device is constructed so that a touch roller 3 is provided at the top end of a touch roller arm 2 to be rotatable with the turning movement of the arm 2 and the approaching direction of the web W to the touch roller 3 and the wrapping direction around the wind roll R making pressure contact with the touch roller 3 are kept in parallel, whereby a total tension loaded on the touch roller 3 acts on the center of it without affecting the direction of the wind roll (cf. JP UM Publication 63(1988)-23389 Y2).

More specifically, the aforesaid device is comprised of one touch roller, the approaching direction of the web to the touch roller being 180° to the outgoing direction from the touch roller and the web embraces or wraps the touch roller by 180°, namely, its half circumference.

The web is wound, being stabilized in a manner that the web immediately before wrapping on the wind roll embraces the touch roller contacting with the wind roll at a suitable angle to the touch roller so as to prevent the web from widthwise laterally shifting. Here, since the touch roller is in pressure contact with the wind roll, air remains between the web lapping the touch roller and the surface of the touch roller and is wound within the web in the form of small wrinkles.

It is therefore essential not to entrain air between the touch roller surface and the web lapping the touch roller. Otherwise, it is preferable that the air, even if entrained, readily escapes and the web does not lap much of the surface of the touch roller.

Moreover, the approaching angle of the web to the touch roller varies in a wide variety of conditions of the web, e.g., characteristics, thickness, width, winding speed and so on, and is not always definite.

In order to tackle with the current situation above, the present invention is aimed at obstructing the entrainment of air by altering and adjusting the approaching angle of the web to the touch roller and, further, at simply substituting an optimal touch roller suitable for webs which vary in physical properties, thickness, width, winding speed, etc., thereby enhancing the quality of the wind roll and the work efficiency.

SUMMARY OF THE INVENTION

A first invention for attaining the aforesaid objects resides in a touch roller device for a web winding apparatus disposed at a position of the web approaching a wind roll being wound on a winding shaft, which device comprises a touch roller disposed in pressure contact with an outer circumferential surface of the wind roll; a guide roller disposed adjacent to and upstream of the touch roller; and touch roller arms spaced apart and provided with both the touch roller and guide roller therebetween, the touch roller and the guide roller being in such a positional relation that the approaching direction of the web to the guide roller and the wrapping direction of the web around the wind roll in pressure contact with the touch roller are generally parallel to each other, the position of the guide roller being controllable in the vertical direction so that the approaching angle of the web to the touch roller making pressure contact with the wind roll can be adjusted.

A second invention resides in a touch roller device for a web winder disposed at a position of the web approaching a wind roll under winding on a winding shaft, which device comprises a touch roller disposed in pressure contact with an outer circumferential surface of the wind roll; one or two guide roller disposed adjacent to and upstream of the touch roller; and touch roller arms spaced apart and provided with both the touch roller and guide roller, the touch roller and the guide roller being in such a positional relation that the approaching direction of the web to the guide roller and the wrapping direction of the web on the wind roll in pressure contact with the touch roller are generally parallel to each other, the guide roller being convertible as a touch roller so that the position of the guide roller can be alternated with the position of the touch roller.

Thus, according to the touch roller device of the invention, when the web is wound around a winding shaft, the approaching direction of the web to the touch roller and the wrapping direction on the wind roll, with which the touch roller is in pressure contact, are kept in parallel. Consequently, a total tension loaded on the touch roller acts on a fulcrum center of the touch roller and such a position that the winding tension does not affect the contact pressure of the touch roller with the wind roll is maintained. In addition, the approaching angle of the web to the touch roller in pressure contact with the wind roll is adjusted by altering the position of the guide roller whereby air is prevented from being entrained between the touch roller surface and the web embracing the touch roller and no small wrinkles are formed in the wound web, thus avoiding a degradation in quality of the web.

BRIEF DESCRIPTION OF THE DRAWINGS

The invention will be hereinafter described in more detail with reference to the accompanying drawings, in which:

FIG. 3 is a diagrammatic view of one example of a prior art touch roller device.

DESCRIPTION OF THE PREFERRED EMBODIMENTS

Figure 1:
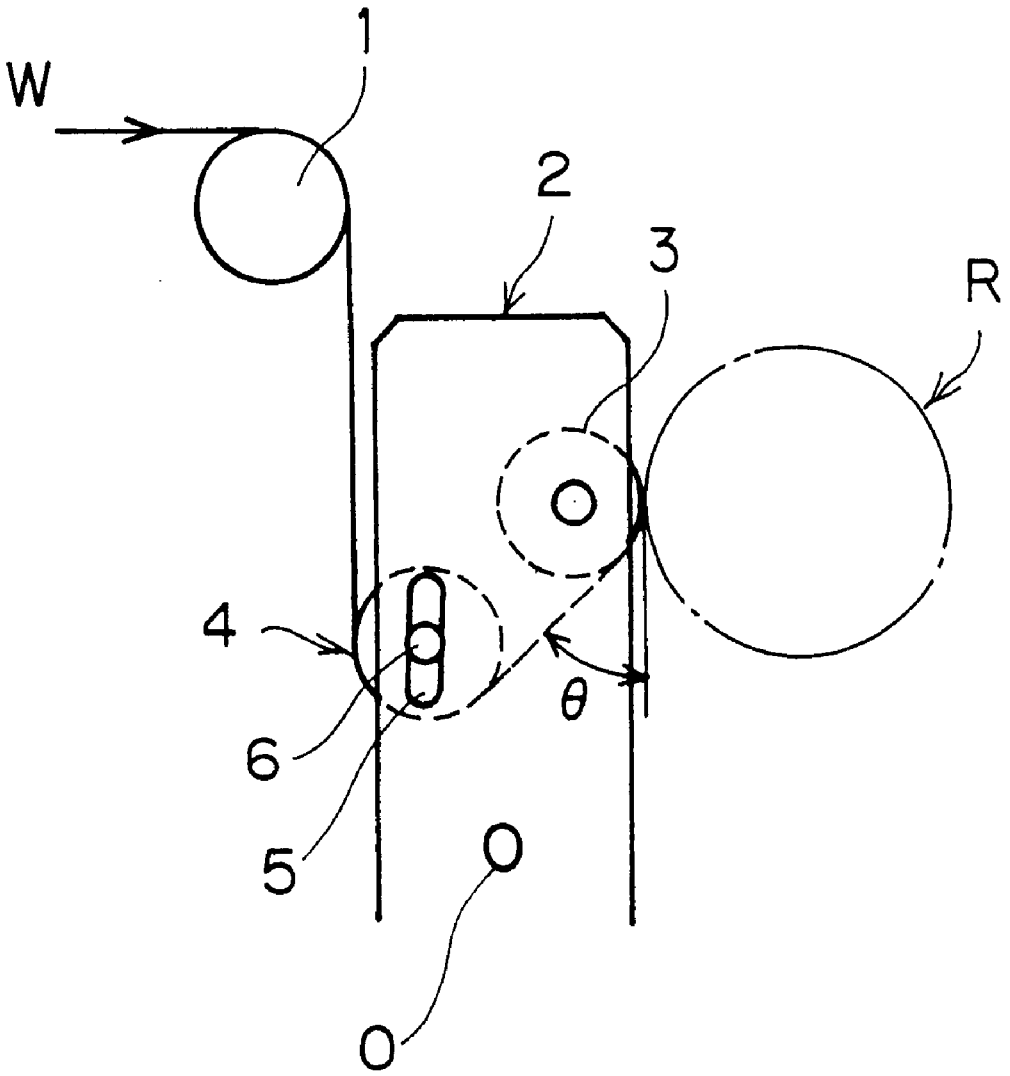
FIG. 1 is a diagrammatic view showing essential parts of one example of a touch roller device pertaining to this invention.

Referring to FIG. 1, a winding embodiment using a touch roller devices relating to the invention is shown, wherein a web W fed via a guide roller 1 approaches a touch roller 3 at a predetermined approaching angle of θ by means of the touch roller device and wraps around a wind roll R.

Here, in the touch roller device characterizing the invention, the touch roller 3 is disposed at an upper part of touch roller arms 2 which have a center of turning movement at their lower parts, and a guide roller 4 is disposed likewise at the touch roller arms 2 to be adjacent to and upstream of the touch roller 3. The guide roller 4 is provided to be vertically displaceable with its shaft end 6 inserted through long holes 5 provided in the touch roller arms 2 so that the approaching angle θ can be varied appropriately by displacing the guide roller. In the figure, a most typical embodiment is shown, wherein the device is comprised of one touch roller 3 and one guide roller 4.

In the construction of the touch roller device above, it is further essential that the direction of web W approaching the guide roller 4 and the wrapping direction to the wind roll R, with which the touch roller is in pressure contact, be generally in parallel to each other.

The reason why both directions are adapted to be in parallel or substantially in parallel with each other in this way is that the total tension loaded on the touch roller 3 acts on the center of a fulcrum of the touch roller 3, namely a center O of the turning movement of the touch roller arms 2, without the contact pressure of the touch roller being affected by the winding tension.

Ultimately, the change in approaching angle θ by the position alteration of the guide roller is determined depending upon the web to be wound, and hence, parameters of the web such as characteristics, thickness, width, speed, etc. are taken into consideration.

For the quality of wind roll, the surface material of the touch roller must be further taken into account together with the aforementioned control of the touch roller in respect of the contact pressure. For instance, the choice of the rubber material, the surface hardness or smoothness of the rubber wrapped around the surface layer of the touch roller, groove cutting processing, etc., is also what matters.

Thus it is possible to obviate the necessity of changing the touch roller whenever the web is changed as is the case with the conventional winder, which resulted in a reduction of work efficiency and operation rate, and the mere change in position of the guide roller suffices in performing the function.

Figure 2A:
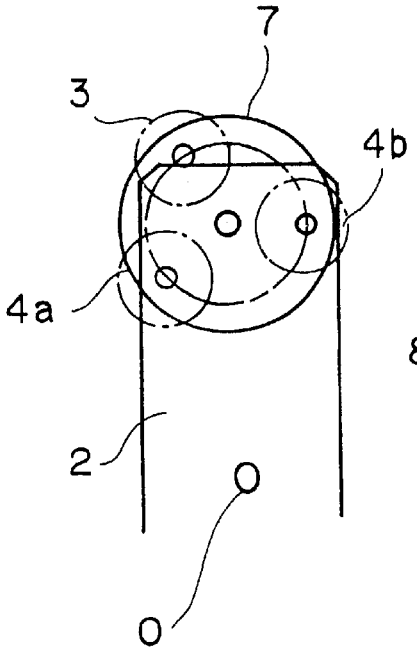
FIG. 2A and FIG. 2B are a diagrammatic front elevational view and a diagrammatic side elevational view, respectively, of another example of a touch roller device showing essential parts thereof.
Figure 2B:
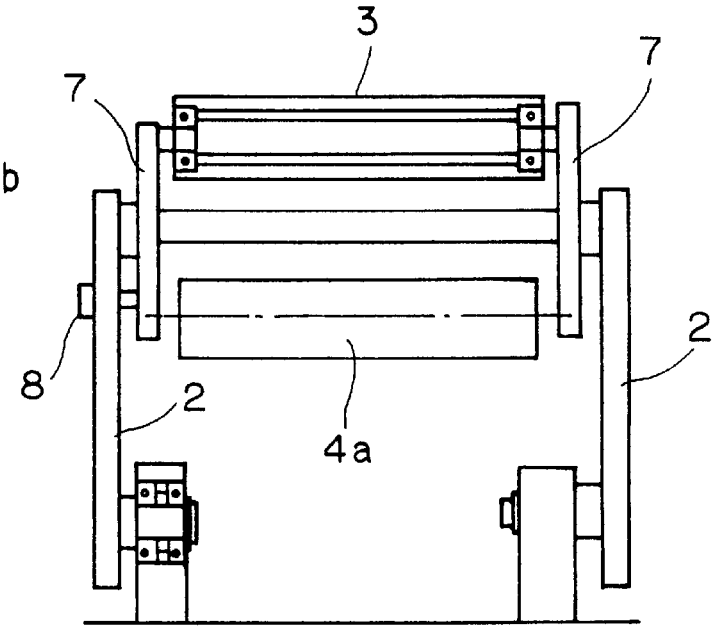

In another embodiment of the invention as shown in FIG. 2, one or two guide rollers are used so as to be convertible as a touch roller, wherein the positions of the touch roller and the guide roller are mutually alternated by turning (rotational) movement, instead of the vertical shifting in FIG. 1.

That is, in that figure, the touch roller arms 2 are, at their insides, provided with arms 7 for alternating the touch roller which are opposed to each other so as to be capable of changing the position of the touch roller by a turning movement. The touch roller 3 and two guide rollers 4*a*, 4*b* in FIG. 2 are mounted rotatably on the touch roller-alternating arms 7 so that when the positions of both are changed by a turning movement, the arms 7 may be secured to the touch roller arms 2 with a lock pin 8.

The embodiment as illustrated above is naturally one exemplary embodiment and the total number of the rollers is not limited to three, but two rollers may also be used. Yet it is not preferred to arrange too many rollers because it complicates the mechanism. The touch roller arms 2 are likewise movable by turning around the rotational center O as a fulcrum at their lower parts.

As described above, in a winding apparatus for winding a web, the invention provides a combination of a touch roller that makes pressure contact with a wind roll on a winding shaft without being affected by the winding tension and a guide roller enabling the adjustment of the approaching angle of the web to the touch roller in pressure contact with the wind roll. As a consequence, it is possible to adjust appropriately the approaching angle of the web in response to the physical properties, thickness, width, speed, etc. of the web wound, without the contact pressure of the touch roller being affected by the winding tension, and accordingly, it is possible to adapt appropriately to the winding of versatile webs. Therefore, it is possible to enhance the running rate of the machine and to improve the work efficiency without the necessity of changing the touch roller whenever the web is changed, as a result of which an optimal wind roll is obtained, maintaining the quality of products.

The second invention is characterized in that one or two guide rollers is combined with one touch roller, and the guide roller is usable also as a touch roller by alternating the positions between the touch roller and guide roller, whereby similar effects to the above can be attained.

What is claimed is:

1. A web winding device comprising:

a winding shaft;

a wind roll provided on the winding shaft;

a pair of touch roller arms provided in spaced-apart relationship and having elongate holes provided therein;

a touch roller mounted between the touch roller arms and provided in pressure contact with an outer circumferential surface of the wind roll;

and a guide roller provided between the touch roller arms adjacent to and upstream of the touch roller and having shaft ends provided in the elongate holes to allow the guide roller to be displaceable in the vertical direction and regulate an approaching angle of the web to the guide roller, the guide roller and touch roller being positioned such that an approaching direction of the web to the guide roller and a wrapping direction of the web around the wind roll are generally parallel to each other.

2. A web winding device comprising:

a winding shaft;

a wind roll provided on the winding shaft;

a pair of touch roller arms provided in spaced-apart relationship;

rotary arms rotatably mounted between the touch roller arms;

a touch roller rotatably mounted to the rotary arms and provided in pressure contact with an outer circumferential surface of the wind roll;

and a guide roller rotatably mounted to the rotary arms adjacent to and upstream of the touch roller, the guide roller being displaceable to the position of the touch roller through rotation of the rotary arms, the guide roller and touch roller being positioned such that an approaching direction of the web to the guide roller and a wrapping direction of the web around the wind roll are generally parallel to each other.

3. A web winding device comprising:

a winding shaft;

a wind roll provided on the winding shaft;

a pair of touch roller arms provided in spaced-apart relationship;

rotary arms rotatably mounted between the touch roller arms;

a touch roller rotatably mounted to the rotary arms and provided in pressure contact with an outer circumferential surface of the wind roll;

and a pair of guide rollers rotatably mounted to the rotary arms adjacent to and upstream of the touch roller, each of the guide rollers being displaceable to the position of the touch roller through rotation of the rotary arms, the guide roller and touch roller being positioned such that an approaching direction of the web to the guide roller and a wrapping direction of the web around the wind roll are generally parallel to each other.

* * * * *